United States Patent [19]

Hopper

[11] Patent Number: 4,684,291

[45] Date of Patent: Aug. 4, 1987

[54] TEMPLATE LEVELLING DEVICE

[75] Inventor: Hans P. Hopper, Whiterashes, Scotland

[73] Assignee: British Petroleum Company p.l.c., London, England

[21] Appl. No.: 858,753

[22] Filed: May 2, 1986

[30] Foreign Application Priority Data

May 8, 1985 [GB] United Kingdom ..... 8511605

[51] Int. Cl.[4] ..... E02B 17/02

[52] U.S. Cl. ..... 405/190; 405/195; 405/224; 254/102

[58] Field of Search ..... 405/195, 224, 221, 227, 405/218, 229, 230; 248/650, 188.4; 254/98, 102

[56] References Cited

U.S. PATENT DOCUMENTS

| | | | |
|---|---|---|---|
| 2,507,900 | 5/1950 | Goetsch | 248/650 |
| 2,687,617 | 8/1954 | Newell | 405/221 |
| 3,314,655 | 4/1967 | Steele | 254/102 X |
| 3,364,636 | 1/1968 | Salsig | 248/650 X |
| 3,546,918 | 12/1970 | Trainer | 248/650 X |
| 3,738,613 | 6/1973 | Hollis | 254/98 X |
| 3,799,197 | 3/1974 | Gibbons | 254/102 X |
| 3,941,352 | 3/1976 | Nehrig et al. | 254/98 |

FOREIGN PATENT DOCUMENTS

| | | | |
|---|---|---|---|
| 2054710 | 2/1981 | United Kingdom | 405/227 |
| 2136036A | 9/1984 | United Kingdom . | |
| 2138472A | 10/1984 | United Kingdom | 405/229 |

*Primary Examiner*—Dennis L. Taylor

*Attorney, Agent, or Firm*—Morgan & Finnegan

[57] ABSTRACT

A screw jack for levelling a subsea template comprises (a) a guided entry adapted to receive a flat-sided drive shaft, (b) an inner screw adapted to be rotated by the drive shaft, (c) a non-rotatable inner housing, through one end of which the screw is threaded, (d) a non-rotatable outer housing, against one end of which the screw bears, the outer housing being axially moveable relative to the inner, (e) a base against which the inner housing rests and (f) one or more projections on the outer housing adapted to bear against corresponding projections on the template.

The arrangement is such that rotation of the drive shaft causes relative axial motion between the inner and outer housings. The jack is suitable for use in diverless systems.

7 Claims, 3 Drawing Figures

TEMPLATE LEVELLING DEVICE

This invention relates to an apparatus and a method for levelling a drilling or production template on the sea bed or similar offshore location, particularly in deep waters.

A considerable proportion of remaining oil reserves is believed to lie offshore under depths in excess of 200 meters, in relatively small oil fields, and in hostile environments. As any one of these conditions intensifies, and more particularly when two or more are combined, the cost of conventional offshore recovery systems wherein drilling and production facilities are mounted on surface platforms rises rapidly and soon becomes uneconomic.

For this reason attention has been given to subsea systems where a favoured technique is to drill a number of locational wells close together and to mount the well head control equipment on the sea bed. In order to do this, a structure known as a template is employed. In essence this is a large frame with guide tubes for drilling which is deposited on the sea bed in a desired location. After drilling, well head completion and production equipment are mounted on the frame and these facilities remain on the sea bed.

This gives rise to further problems, however. The sea bed is frequently uneven and the template requires to be levelled horizontally to minimise operational problems during the drilling and production programmes. Also the template may well be situated at depths beyond the limits of current diving technology.

We have now devised an apparatus and a method for levelling a subsea template which does not require the use of divers.

Thus according to one aspect of the present invention there is provided a screw jack for levelling a subsea template, the screw jack comprising (a) a guided entry adapted to receive a flat-sided drive shaft
(b) an inner screw adapted to be rotated by the drive shaft,
(c) a non-rotatable inner housing, through one end of which the screw is threaded,
(d) a non-rotatable outer housing, against one end of which the screw bears, the outer housing being axially moveable relative to the inner,
(e) a base against which the inner housing rests, and
(f) one or more projections on the outer housing adapted to bear against corresponding projections on the template, the arrangement being such that rotation of the drive shaft causes relative axial motion between the inner and outer housings.

Preferably the inner and outer housings are cylindrical in shape.

Preferably the lower end of the inner cylinder is fitted with a curved base surrounded by a flat cylindrical cover. This enables the jack itself to assume a vertical position even when the surface against which it bears is inclined.

Preferably the cylindrical cover rests against a shoe-plate to distribute the load.

The housings may be prevented from rotating by the use of suitable stops and shoulders on the housings.

The flat-sided drive shaft may be of hexagonal or octagonal cross-section. It may be a shaft from a drilling rig. It could be a drill pipe Kelly but, preferably, a purpose-designed drive shaft is used. Alternatively a sub-sea hydraulic motor above the levelling jack could be used with the flat-sided drive shaft extending from the motor into the jack. The hydraulic power could be supplied from a drilling rig or other surface vessel.

The pitch of the screw should be designed so that the rotational torque force does not exceed that of the power available from the rig or other vessel.

Thus the jack may be operated from a drilling rig or other vessel without the intervention of divers. Assistance could, however, be given by a remotely operated vehicle if required. The drive shaft is stabbed into the guided entry and thence into the screw. This action also forces the jack down against the seabed.

In order to level the template three or more levelling jacks may be employed.

Thus according to another feature of the present invention there is provided a method for levelling a subsea template which method comprises the steps of (a) coupling three or more jacks as hereinbefore described to the template to form the corners of a polygon.
(b) lowering the template to the sea bed,
(c) actuating a jack or pair of jacks until it has brought its section of the template level with that of another jack,
(d) actuating the remaining jack or jacks until it has brought its section of the template level with that of the others, and
(e) fixing the levelled template in position by piling.

The simplest levelling system uses three jacks at the apices a triangle. One jack is actuated to bring it to the level of an adjacent jack and the remaining jack is then actuated to bring it to the level of the other two.

Preferably, however, four jacks are used, preferably at the corners of the template. Jacks may then be used in pairs, if desired, to adjust sides of the template rather than simply corners or midpoints of the sides.

The jacks can, if desired, be removed for use on another template. They may, however, be left in position to provide additional support for the template.

Precise adjustments can be carried out as the screws act as their own locks.

A screw jack according to the present invention is a precise yet robust levelling device which is cheap and re-usable.

The invention is illustrated with reference to the following drawings wherein

Figure 1:
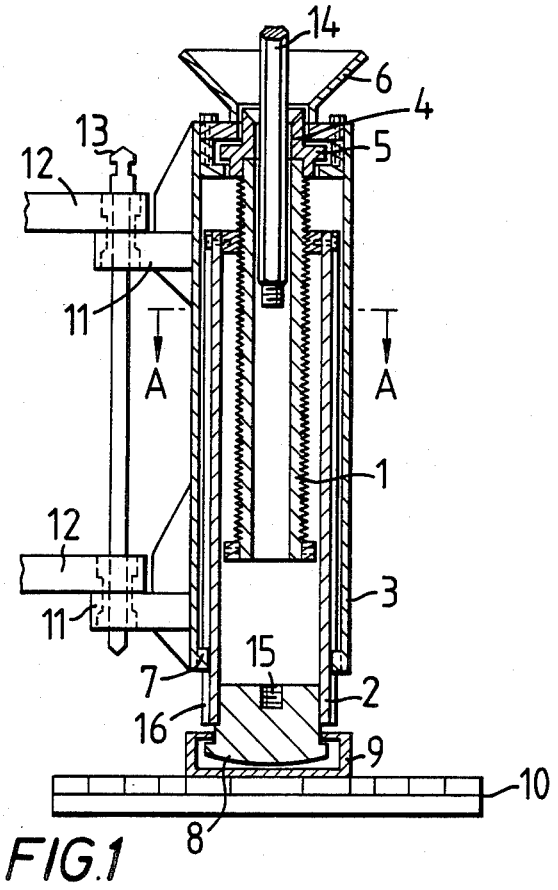
FIG. 1 is a section of a screw jack.
Figure 2:
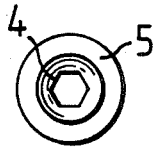
FIG. 2 is a plan of the hexagonal screw bushing subsequently referred to as Item 5 and FIG. 3 is a section on AA of FIG. 1.
Figure 3:
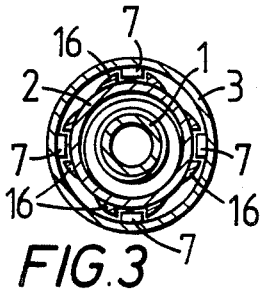

The jack comprises a screw 1 threaded through the top of a cylindrical inner housing 2 contained within a coaxial cylindrical outer housing 3.

The screw contains an internal hexagonal channel 4 and its upper end is fitted with a hexagonal screw bushing 5 which bears against the top of the outer housing 3.

The upper end of the outer housing 3 is fitted with a conical guide funnel 6.

The outer housing 2 is fitted with anti-rotation stops 7 which cooperate with shoulders 16 on the inner housing. The stops 7 could, if desired, be on the inner housing, with the shoulders on the outer housing. Its lower end is fitted with a curved base 8 surrounded by a cylindrical cover 9 which rests against a shoe-plate 10. The curved base is attached to the main body of the jack by bolt 15.

The outer housing 3 is also fitted with shoulders 11 which underlie and support corresponding shoulders 12 on a template (not shown). A releasable pin 13 locks the shoulders 11 and 12 in position. The jack may be kept in place during the life of the template shoulders 11 of the jack helping to support the template. Alternatively, by releasing pin 13 and rotating the whole jack so that shoulders 11 clear the template shoulders 12, the jack may be recovered for reuse.

The jack is actuated by a hexagonal drive shaft 14 operated by a drilling vessel on the surface of the sea or by a hydraulic motor above the jack supplied with hydraulic power from a surface vessel.

To operate the jack, the drive shaft 14 is guided by the funnel 6 and stabbed into channel 4 in the screw 1. Shaft 14 is then rotated and this in turn rotates the screw 1 and causes it to rise out of the inner housing 2 carrying the screw bushing 5 with it. Since the latter bears against the underside of the top of the outer cylinder 3, the cylinder 3 is also raised taking with it its shoulders 11 and the template shoulders 12, and hence the template itself.

I claim:

1. A screw jack for levelling a subsea template by means of a remote drive shaft, the screw jack comprising:

(a) A guided entry adapted to receive a remote flat-sided drive shaft, (b) An inner screw adapted to be rotated by the drive shaft, (c) A non-rotatable inner housing, through one end of which the screw is threaded, (d) A non-rotatable outer housing, against one end of which the screw bears, the outer housing being axially moveable relative to the inner, (e) A base against which the inner housing rests, and (f) One or more projections on the outer housing adapted to bear against corresponding projections on the template, the arrangement being such that rotation of the drive shaft causes relative axial motion between the inner and outer housings.

2. A screw jack according to claim 1 wherein the lower end of the inner cylinder is fitted with a curved base.

3. A screw jack according to claim 2 wherein the curved base is surrounded by a flat cylindrical cover.

4. A screw jack according to claim 3 wherein the flat cylindrical cover rests against a shoe-plate.

5. A screw jack according to claim 1 wherein the drive shaft is driven from a drilling rig.

6. A screw jack according to claim 1 wherein the drive shaft is driven by a hydraulic motor above the jack.

7. A method for levelling a subsea template which method comprises the steps of:

(a) Coupling three or more jacks according to claim 1 to the template to form the corners of a polygon, (b) Lowering the template to the sea bed, (c) Actuating a jack or pair of jacks using a remote drive shaft until it has brought its section of the template level with that of another jack, (d) actuating the remaining jack or jacks using a remote drive shaft until it has brought its section of the template level with that of the others, and (e) Fixing the levelled template in position by piling.

* * * * *